United States Patent [19]

Larsson

[11] Patent Number: 5,071,067

[45] Date of Patent: Dec. 10, 1991

[54] METHOD AND EQUIPMENT FOR ATOMIZING LIQUIDS, PREFERABLY MELTS

[75] Inventor: Hans-Gunnar Larsson, Västeras, Sweden

[73] Assignee: H. G. Tech AB, Västeras, Sweden

[21] Appl. No.: 488,031

[22] PCT Filed: Dec. 5, 1988

[86] PCT No.: PCT/SE88/00671

§ 371 Date: May 23, 1990

§ 102(e) Date: May 23, 1990

[87] PCT Pub. No.: WO89/05197

PCT Pub. Date: Jun. 15, 1989

[30] Foreign Application Priority Data

Dec. 9, 1987 [SE] Sweden ..... 8704906

[51] Int. Cl.[5] ..... B05B 17/00; B22F 9/08

[52] U.S. Cl. ..... 239/8; 239/82; 239/296; 425/7

[58] Field of Search ..... 425/7; 75/339, 443; 239/11, 13, 8, 82, 290, 296

[56] References Cited

U.S. PATENT DOCUMENTS

| | | | |
|---|---|---|---|
| 2,341,704 | 2/1944 | Ervin | 425/7 X |
| 2,614,619 | 10/1952 | Fuller | 425/7 X |
| 3,593,976 | 7/1971 | Hager | 425/7 |
| 4,221,554 | 9/1980 | Oguchi et al. | 425/7 |

FOREIGN PATENT DOCUMENTS

| | | | |
|---|---|---|---|
| 703239 | 12/1979 | U.S.S.R. | 425/7 |

*Primary Examiner*—Andres Kashnikow
*Assistant Examiner*—Kesin P. Weldon
*Attorney, Agent, or Firm*—Dennison, Meserole, Pollack & Scheiner

[57] ABSTRACT

The invention is a method and apparatus for atomizing metal melts by disintegration of a vertical tapping stream of the melt with the aid of horizontal media jets of pressurized gas. The media jets are formed by two slot-shaped nozzles or row of nozzles separate from each other. The jets are oriented to flow at an angle beta between the media jets. A zone is established between the media jets just prior to the intersection of the tapping stream with the media jets. The tapping liquid is drawn back into the zone by the media jets action.

14 Claims, 4 Drawing Sheets

METHOD AND EQUIPMENT FOR ATOMIZING LIQUIDS, PREFERABLY MELTS

Figure 1:
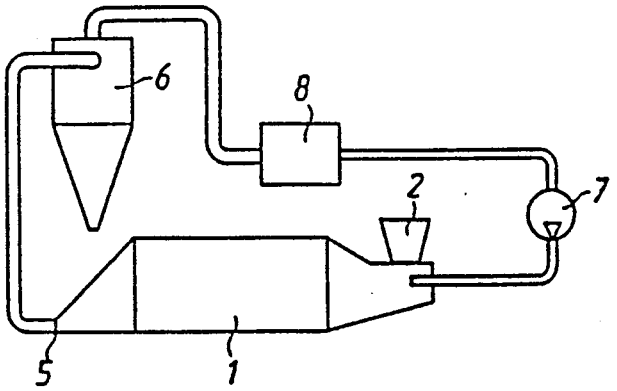

The present invention relates to a method of atomizing liquids, preferably metal melts, by disintegration of a preferably vertical tapping stream of the liquid with the aid of preferably horizontal media jets consisting of gas or liquid. The invention also relates to a means for performing said method.

When liquids are atomized by disintegration of the liquid with the aid of a gas or fluid, extremely particles are obtained within certain size intervals, the intervals sometimes being considerable.

These known methods can be used for most types of liquids. However, they apply primarily to the production of powder from metal melts where a gas, e.g. nitrogen or argon, is used as atomization medium. Powder manufactured in this manner is often said to be manufactured inertly and is characterised by its low oxygen content and spherical form.

Powder-metallurgy processes using inertly manufactured powder encounter various problems relating to the size of the powder particles and/or their distribution.

Finer and/or narrower fractions of inertly manufactured powder is desirable for many applications nowadays. Such powder is conventionally obtained by screening off a coarser fraction, resulting in low yield, or via atomization processes using extreme gas flows and pressures. This powder is only used to a limited extent due to its high cost.

Typical fractions for unscreened powder manufactured by a number of conventional methods are: 0–300 my, 0–500 my, 0–1000 my. The average particle size in these fractions is 80, 110 and 120 my, respectively.

Problems have been encountered in reducing the particle size and the wide spread of particle sizes in the finished powder, at a reasonable cost.

A number of powder-metallurgy (PM) processes are described below, showing the required or preferred powder sizes and fractions which can be achieved by means of the present invention.

PM methods in which products are obtained in almost finished form by means if hot isostatic pressing without subsequent heat treatment: Established process are today limited when it comes to achieving high fatigue-resistance values since fatigue resistance is usually determined by the largest non-metallic inclusions in the material. The impurities come from the powder manufacture and can only be eliminated with certainty by using a screened fraction in which the max. powder size (=max. impurity size) is no greater than the acceptable defect magnitude. Powders desirable here may be <80 my, <60 my, <40 my, etc.

Powder for surface coating by means of welding or spraying:

Certain powders for these purposes are currently produced with yields of less than 50% due to the wide fraction distribution in the manufacturing processes. Typical fractions for these purposes are: 50–150 my, 20–550 my, 20–70 my, 34–104 my, etc.

Injection moulding (IM) is a relatively new technique in the PM field:

An extremely fine fraction of metal powder is mixed with plasticizer, and components are then injection-moulded within extremely narrow tolerances. The binder is then burnt off in a furnace, after which the component is sintered to high density. Typical powder sizes desired may be: <15 my, <22 my, <44 my, respectively, depending on the process used.

Production of alloys which acquire their properties through extremely rapid cooling:

A method of manufacturing powder of fine fraction can in principle automatically be used to produce these alloys since the completely dominating factor for the cooling rat is inversely proportional to the size of the drops.

The method of, by means of sintering, producing large products in almost finished form and blanks for further heat-treatment such as rolling, as an alternative to the more expensive HIP method.

The size desired is substantially the same as for IM.

The method of creating fiber-reinforced composites with matrices of metal

Hitherto the technique has not been developed to any great extent but where successful experiments have been carried out via PM, the technique has been based on extremely fine powder fractions.

The method according to the invention provides a solution of these and other associated problems, and is characterised in that two streams of a disintegration medium having considerable vertical extension and a horizontal flow direction are formed by two slot-shaped nozzles or rows of nozzles, separated from each other and located at the same level, said jets being caused to flow at such an angle $\beta$ between the media jets in a vertical plane that a zone is established between the media jets immediately before the vertical intersection line therefor, where intake of a stream of surrounding medium is compensated by backwardly outflowing disintegration medium, and that the tapping stream is caused to pass down between the media jets in the zone established.

When atomizing metal melts in which a tapping stream is encountered by one or more gas jets of an atomization medium, instability is produced on the surface of the melt in the contact surface between melt and gas, causing the melt to be stretched out in thin films. When these films have reached a certain thickness they will be broken up into threadlike pieces due to the surface tension of the melt. These threadlike pieces will then be twisted off under influence of the surface tension, into a number of bits which assume a shape having the least possible surface energy, i.e. spherical shape.

These spherical drops solidify to powder particles extremely rapidly due to thermal radiation and convective dissipation of heat to the gas.

The size of particles formed is affected by a number of parameters, the surface tension of the melt and the density and velocity of the atomizing medium being the most influencial. The influence of the velocity is also quadratically dependent.

It is difficult to influence the surface tension or density for a given melt and a given atomizing medium, and it is therefore simplest to influence the particle size by means of the the velocity of the atomizing medium. In most established atomizing processes, therefore, high velocities are strived for by means of high pressure in the atomizing medium and, in the case of gaseous media, by Laval design of the nozzles.

However, the velocity of gaseous atomizing media decreases extremely rapidly after the nozzle so that usually only a small proportion of the atomizing process occurs within the region of maximum velocity.

A larger or smaller proportion of the melt will be disintegrated to particles in a region further away from the nozzle, where the velocity is considerably less, in some cases even as low at 10% of the maximum velocity. This gives a powder with a wide spread between the smallest and largest particles.

With a method and means according to the invention, the problems mentioned above can be greatly reduced since the contact surface between melt and atomizing medium is increaed many times. This results in the atomization process occurring within a short region after the nozzle, where the velocity of the atomizing medium is high.

The invention utilizes a flow phenomenum which arises when two jets of gas or fluid encounter each other at a certain angle. It is known that at or immediately before the point of intersection between two media jets encountering each other at an angle, a flow phenomenum occurs which dominates the process to a greater or less extent depending on the size of the angle. At small angles, e.g. smaller than 5°, the injector action due to the sub-pressure immediately before the point of intersection is the dominant property, whereas at larger angles, e.g. 120°, there will be a backward flow of media in relation to the main direction of flow of the media jets.

According to the invention both these phenomena are exploited by selecting such an angle between two media jets that such a large backward flow of media occurs that, within a short distance, it is drawn back into the media jets by the injector action. The result will be that a zone is established in fron of the intersection point, where there is no defined direction, but only two vortex eddies with a constant exchange between returning media and media drawn in. Altering the angle will increase or decrease the extent of this zone. The angle between the media jets may be 0°–60°, but is preferably 5°–20°.

According to the invention the atomizing nozzle is in the form of two horizontally directed media jets, parallel in the vertical plane and having considerable vertical extension in comparison with the width and having an angle in the horizontal plane in relation to each other so that the described above is established. The tapping stream will flow from the top, down in the vertical zone formed all along the height of the nozzle, the stream thus being successively disintegrated by the passing atomizing medium, on its way down. Media jets with considerable extension in one direction can be achieved by means of slot-shaped nozzles or by a number of circular nozzles, for instance, arranged close together in a row. Depending on prevailing pressure and the medium used, the nozzle for the media jets may be designed for sub-pressure or over-critical pressure conditions (Laval nozzle). When the flow of melts is correctly adjusted to the capacity of the media nozzle, atomization will occur along the entire height of the nozzle.

It can easily be ascertained that correct and maximum capacity is being used, since if too little melt is flowing the melt will finish part of the way down the height of the nozzle or if too much melt is flowing it will run out at the lower edge of the nozzle without being atomized. The vertical contact region between gas and melt suitably has a length 5 to 50 times longer than the diameter of the tapping stream, preferably a length between 10 and 30 times the diameter. A nozzle having a height of 100 mm or more will function very steadily, with a uniform distribution of the quantity of atomized melt per height unit at a typical diameter for the tapping stream, e.g. 6 mm.

In order maitain a high speed for the media jets within the atomization region, the described media nozzles may be supplemented by one or several extra pairs of media nozzles. These can be placed on each side of the main stream containing the melt, with the object of reducing velocity losses.

In order to prevent melt which has not been atomized from running out below the media jets if too large a melt flow should be used, the nozzle may be provided with an extra media jet forming a bottom in relation to the two media jets described.

The angle between the tapping stream and the media jets may vary. The media jet may be substantially horizontal, i.e. the angle between the tapping stream and the media jet is 90°, but this may be varied within wide limits. The angle may be between 45° and 135°, preferably between 80° and 100°.

If the media jets have an outflow direction differing from the horizontal, the angle of the vertical zone described previously will also alter to a corresponding degree, so that the zone and the tapping stream are no longer parallel. This effect can be exploited if it is desirable for the tapping stream to cut further or not so far into the media jets during its passage downwards in the zone. If the media jets are directed upwardly in relation to the horizontal plane, the tapping stream in the lower part of the atomizing region will be further from the intersection point of the media jets. If the media jets are directed downwards in relation to the horizontal plane, the opposite will occur, i.e. the tapping stream in the lower part of the atomizing region will move closer to the intersection point.

Utilizing this effect allows the amount of liquid atomized per height unit of the media jets to be regulated by altering the angle of the media jets in relation to the horizontal plane.

Another method of achieving this control is by inserting a number of smaller nozzles between the media nozzles, said smaller nozzles being distributed vertically and acting in the same direction as the media nozzles, but having individually controlled flows directed towards the tapping stream. The number of these nozzles may preferably be such that, when placed one above the other, they have the same height as the media jets.

By allowing the tapping stream to encounter the zones described earlier as far away as possible from the intersection point of the media jets and/or by selecting the horizontal angle between the media jets so that a greater tendency to back-flow is achieved, the point at which the tapping stream encounters the media jets can be controlled along the atomizing region by regulating the flows in the various smaller nozzles. When a media jet from the smaller nozzles encounters the tapping stream, the tapping stream will be deflected and forced towards the intersection point of the media jets.

A third method of obtaining this control possibility is obtained by directing the media-jet nozzles at an angle in the vertical plane, i.e. the media nozzles are no longer parallel. Altering this angle will cause the distance from nozzle to intersection point to vary along the height of the atomizing region. Depending on whether the angle is selected so that the distance between the nozzles is greatest at the upper or at the lower edge, the zone described will be inclined away from or towards the centre line of the tapping stream. This possibility of controlling the inclination of the zone enables the previously described effect of letting the tapping stream cut further or not so far into the media jets, to be achieved.

In order to simplify adjustment of the point of encounter between tapping stream and media jets, the nozzles for the atomizing media can be made movable and adjustable in horizontal plane. The whole arrangement of the nozzle must then be adjusted to achieve the correct point of encounter.

Another way of achieving the desired point of encounter is to arrange small extra nozzles above the media nozzles, directed substantially horizontally, their outflow being directed towards the tapping stream. By surrounding the tapping stream with a plurality of these extra nozzles, operating from different directions and with individually adjustable flows, the vertical direction of the tapping stream can be influenced and the desired point of encounter thus achieved.

Small particles with very little variation in size can be manufactured using the method described above.

Additional improvement of the atomizing process can be achieved according to the invention by inserting guides on each side of the stream after the point of encounter, where the media jets converge to a stream containing the melt. The height of the guides is equal to or greater than the height of the stream and located so as to reduce lateral expansion of the jet, and thus also loss of velocity in the media jet.

The guides may be corrugated at the rear edge, or shaped in some other way so that the jet is alternately directed along the height towards the centre and straight forwards.

In such a method, the guide is preferably shaped on the opposite side so that control of the jet is phase-shifted. The result will be that the media jet will be wave-shaped if seen in section from the front along the height. The film of melt in the jet will be affected by the alternating deflection of the jet to the sides, partly by the contact surface to the gas being enlarged and partly by the turbulence in the contact surface being increased. Both effects promote the atomizing process.

The alternating action of the media jets containing the melt can also be achieved by placing a number of smaller media jets in rows, suitably spaced and at a suitable distance after the intersection point of the media jets, on each side of the media jet, directed so that the preferably encounter the media jet perpendicularly from the side. The smaller nozzles located on each side are placed with such pitch in relation to each other that the desired alternating action of the media jets is achieved.

The invention also relates to a means for performing said method. The features characteristic of this means are defined in the appended claims.

The atomizing plant comprises a closed system, preferably kept under a certain overpressure, e.g. 500 mm water column, so that air is prevented from entering. The system comprises a preferably horizontal, cylindrical chamber. A casting box or runner box is located at the end of the chamber. Molten metal runs from this via a tapping stone, down into the chamber. An atomizing nozzle shaped to form two horizontal media jets, parallel in vertical plane, and with considerable vertical extension in comparison with their width, having an angle in the horizontal plane in relation to each other such that a neutral zone is formed immediately before the intersection point of the jets, is placed in the chamber so that the tapping stream encounters said zone. Particles produced at atomization are drawn into the gas jet towards the other end of the chamber and, before encountering the end of the chamber, they are solidified into powder by radiation and convective heat dissipation to the gas. The chamber is preferably provided with an outlet hole in the end piece, towards which the gas/powder mixture flows.

So that all the powder will accompany the gas through the outlet hole, and not be deposited at the bottom of the chamber due to the strong turbulence prevailing, the atomizing nozzle may be located asymmetrically below the centre line of the chamber. An effect similar to that used in a fluidizer is then achieved, which means that the gas from the atomizing nozzle will be deflected and attracted to the bottom, thus preventing the powder from collecting there. Instead it is transported to the outlet opening. This deflection effect can be enhanced by placing a number of gas nozzles, together forming a gas curtain, in the bottom/sides of the atomizing chamber. These gas-curtain nozzles should be placed on the inner periphery of the chamber in two axial rows, one on each side of the vertical plane of symmetry of the chamber, at a height above the bottom corresponding to a tangential angle on the periphery which is equal to or greater than the angle at which the powder falls. The outlet of the gas-curtain nozzles is shaped so that a curtain-like gas jet is formed parallel to the chamber wall having such angular extension that an area of the chamber wall is covered which is limited by the direction tangentially downwards along the chamber wall and the direction for instance 30° below the horizontal plane.

Spacing the curtain nozzles suitably, so that a certain overlap is achieved, will produce a gas curtain along the entire bottom, converging towards the outlet hole. The chamber is connected from the outlet by pipes, to a cyclone where the powder and gas are separated. After separation, the gas may travel to a compressor via a gas cooler, for recirculation to the atomizing nozzles. The system includes other requisite valves, cooling equipment and control means for regulating gas pressure, temperature and the various media flows, etc.

The method and equipment according to the invention also enables spray-deposition to be performed: the gas-particle mixture is sprayed against a matrix or starting blank before the particles have solidified, so that a blank of the relevant alloy can be built up. The blanks can be built up on stationary or movable matrices. Particles which do not encounter the blank form powder and are taken care of by the same procedure as described previously for powder.

One embodiment of the invention is shown in the accompanying drawings, in which

Figure 2A:
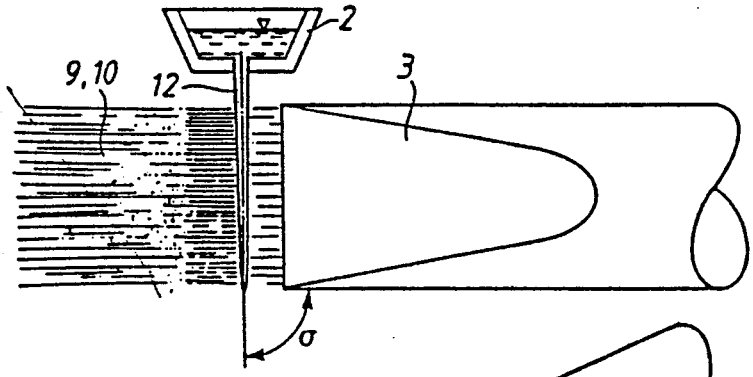
Figure 2B:
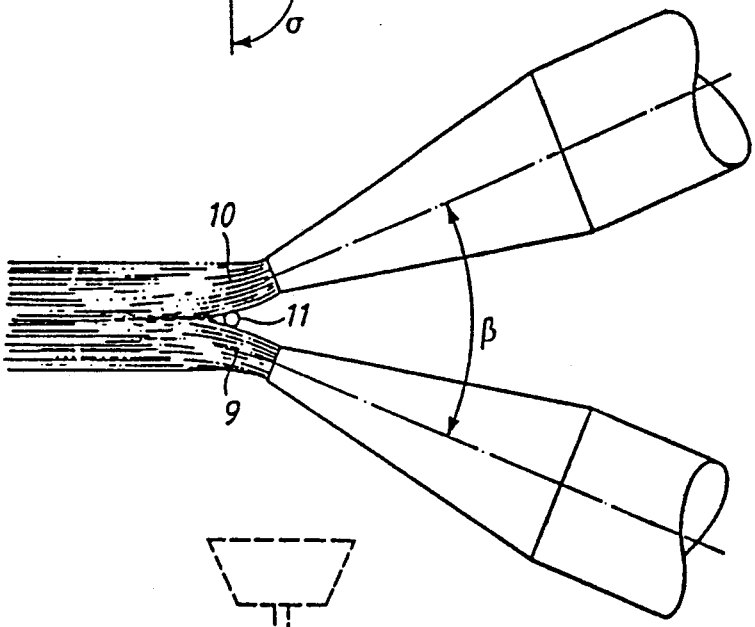
Figure 2C:
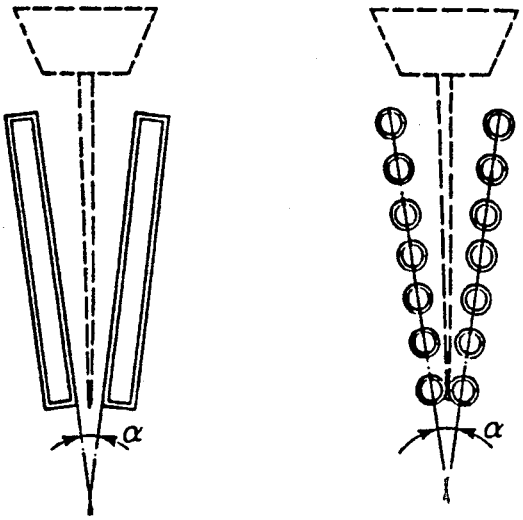
Figure 3A:
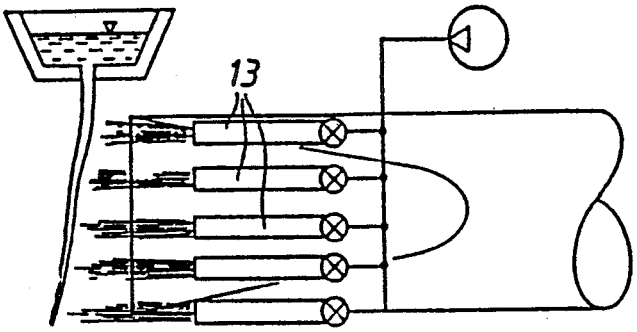
Figure 3B:
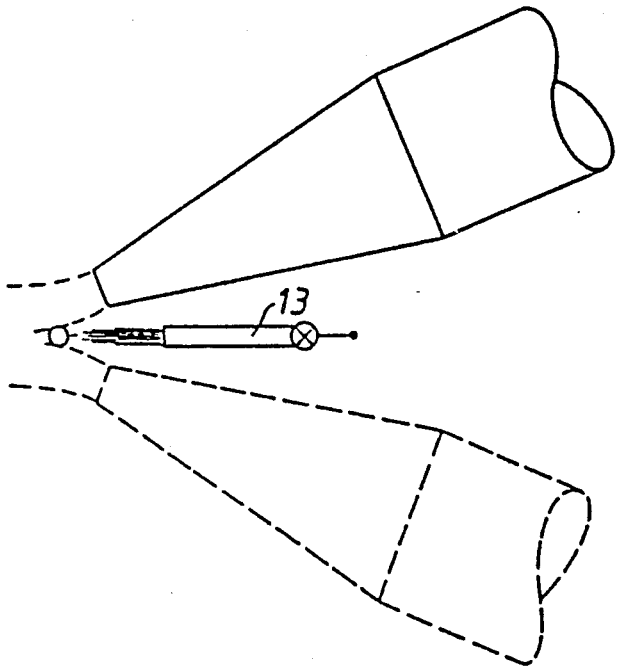
Figure 3C:
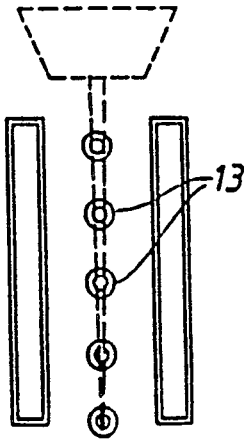
Figure 4A:
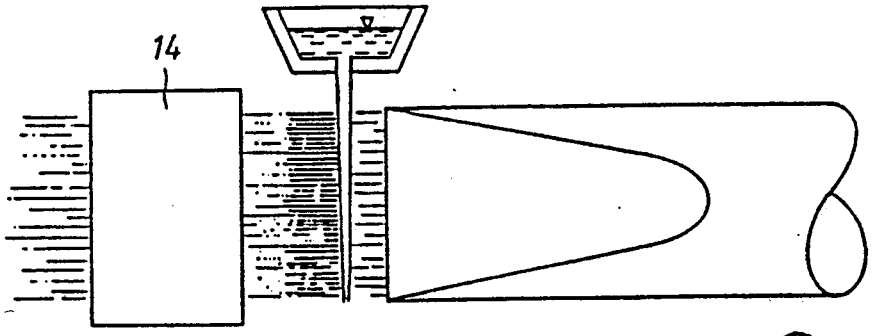
Figure 4B:
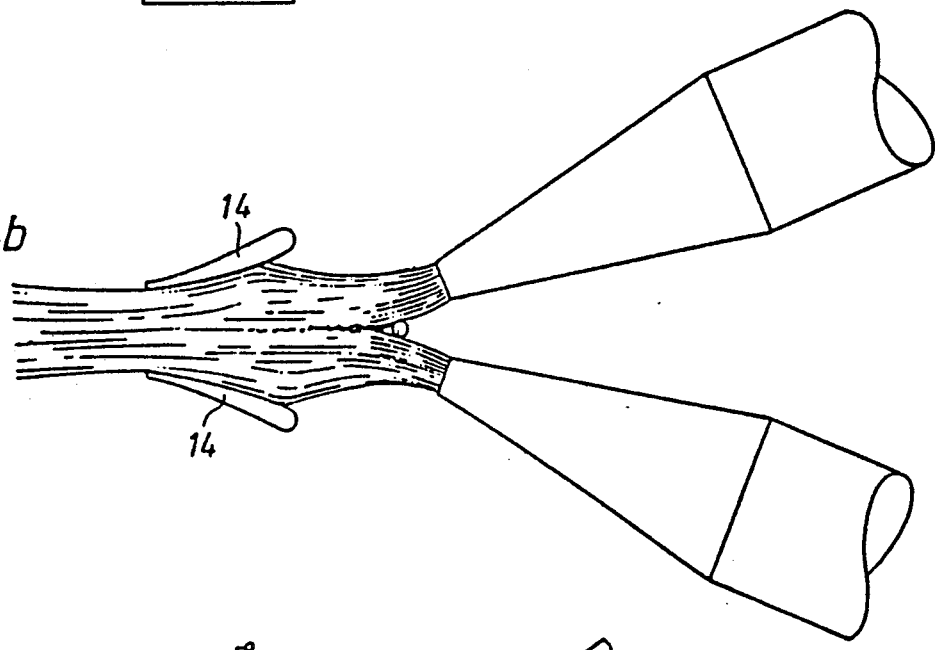
Figure 4C:
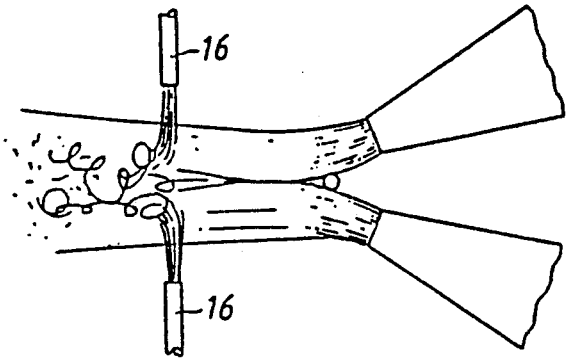
Figure 5:
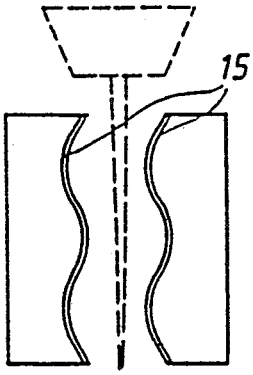
Figure 6A:
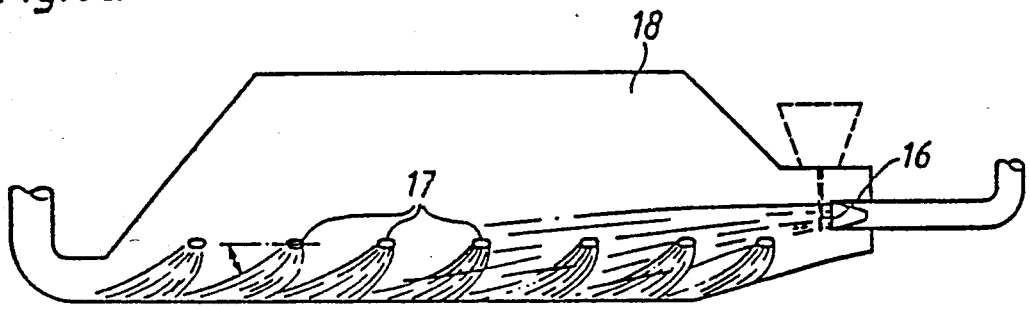
Figure 6B:
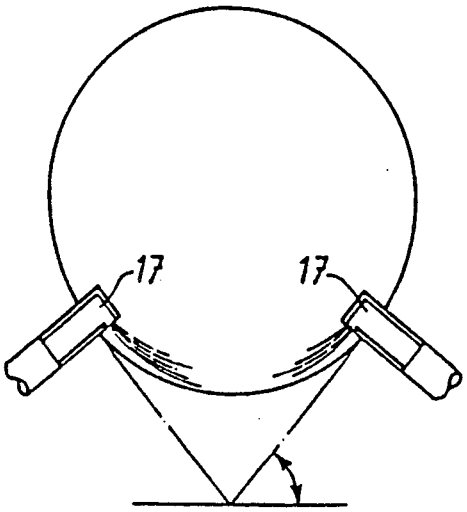
Figure 7:
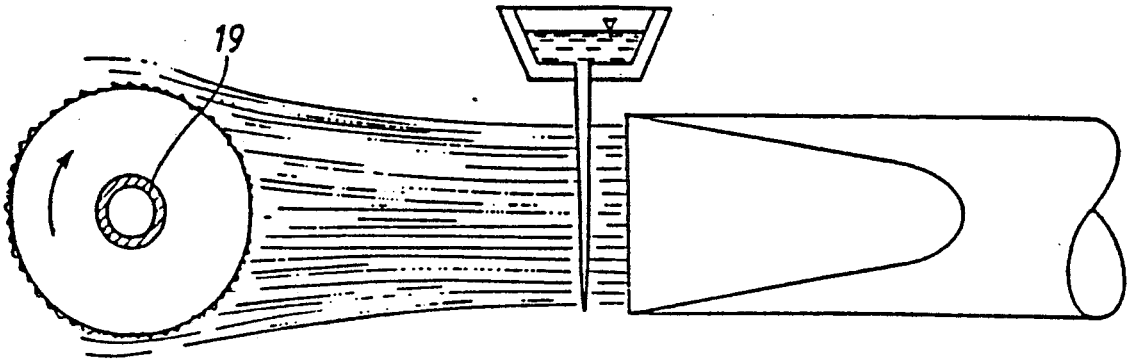

FIG. 1 shows the entire equipment,

FIG. 2*a* shows the flow process seen from the side,

FIG. 2*b* shows the same process seen from above,

FIG. 2*c* shows a variant of the angle between the slots,

FIG. 2*d* shows the equivalent with two nozzles,

FIG. 3*a* shows a means with extra nozzles,

FIG. 3*b* shows the same means seen from above,

FIG. 3*c* shows a view from the front with extra nozzles,

FIGS. 4*a* and 4*b* show a means with guides, seen from the side and above, respectively, FIG. 4*c* shows a means with a number of smaller media nozzles, FIG. 5 shows a guide variant FIG. 6*a* shows an atomizing means with a number of inclined nozzles FIG. 6*b* shows the same means seen from the end, and FIG. 7 shows a means with spray-deposition.

FIG. 1 shows a means according to the invention with an atomizing chamber 1, forming part of a closed system which is preferably kept at a certain over-pressure, e.g. 500 mm water column, to prevent air from entering. At one end of the chamber 1 is a casting box 2 or runner box. The chamber is preferably horizontal and molten metal runs from the casting box 2 via a tapping stone, down into the chamber 1. An atomizing nozzle (3 in FIG. 2*a*) is shaped to form two horizontal media jets, parallel in the vertical plane, and with considerable vertical extension in comparison with their width, and also having an angle in the horizontal plane in relation to each other such that a neutral zone is formed immediately before the intersection point of the jets. This is located in the chamber 1 so that the tapping stream 4 encounters this point. Particles are thus produced through this atomization and are drawn with the gas jet towards the other end of the chamber where, before encountering the end wall of the chamber, they are solidified into powder by radiation and convection. The chamber 1 is connected from an outlet hole in the end wall 5, with a cyclone 6 in which the gas and powder are separated. After separation, the gas flows to a compressor 7 via a gas-cooler 8 for recirculation to the atomization nozzle 3.

FIGS. 2*a* and 2*b* show the atomization nozzle in the form of two horizontally directed media jets 9, 10, parallel in the vertical plane and having considerable vertical extension in comparison with their width. The angle $\beta$ between the media jets is given such a value that a zone 11 is established, where inflow of the surrounding medium is substantially compensated by the backward outflow of the media. The tapping stream 12 is caused to pass through this zone 11. The angle ($\sigma$) between the tapping stream and the media jets may vary. The media jet may be substantially horizontal, i.e. $\sigma$ is 90°, but it may vary between 45° and 135°, preferably between 80° and 100°.

The vertical contact region between gas and melt suitably has a length 5 to 50 times longer than the diameter of the tapping stream 12, preferably 10–30 time the diameter.

The slot-shaped nozzles 3 may form an angle of 0°, i.e. they may be parallel, or they may form an acute angle ($\nu$) of less than 45°. This is illustrated in FIGS. 2*c* and 2*d* showing outflow nozzles formed from slot-shaped and individual nozzles, respectively. Varying this angle enables inclination of the zone to be regulated so that the tapping stream cuts further or not so far into the intersection point of the media jets.

The quantity of liquid atomized per height unit of the media jets can be controlled by angle alterations of this type.

Another means and method of obtaining this control possibility is achieved (see FIGS. 3*a*–3*c*) by inserting a number of vertically distributed smaller nozzles 13 between the media nozzles, these smaller nozzles being directed in the same direction as the media nozzles but having individually controllable flows directed towards the tapping stream. Their total height may substantially correspond to that of the slot-nozzles. This can be seen particularly clearly in FIG. 3*c*.

A further improvement of the atomization process can be achieved, as described above, by inserting guides 14 (see FIGS. 4*a* and 4*b*) after the point of encounter 11. These are placed on each side of the stream, are the same height or slightly taller than the height of the stream and are located so as to reduce lateral expansion of the jet, as revealed in FIG. 4*b*.

The guides may also be corrugated at the rear edge (see FIG. 5), or be shaped in some other way so that the jet is alternately directed along the height towards the centre and straight forwards (15). The effect of this is described in more detail above.

FIG. 4*c* shows a number of media jets 16 arranged at a suitable distance from and on each side of the media jet, thus influencing the media jet alternately.

So that the powder will accompany the gas through the outlet hole, and not be deposited at the bottom of the chamber due to the strong turbulence prevailing (see FIGS. 6*a* and 6*b*), the atomizing nozzle may be located asymmetrically (16) below the centre line of the chamber 18. As described above, the gas from the nozzle will then be deflected and attracted to the bottom, thus preventing the powder from collecting there. This effect can be enhanced by placing a number of gas nozzles 17 forming a gas curtain, in the bottom of the chamber. See also the relevant description above.

The method and equipment according to the invention also enables spray-deposition to be arranged, which means that the gas-particle mixture is sprayed against a matrix 19 ((FIG. 7) or starting blank before the particles have solidified, thus building up a blank of the relevant alloy. Powder not adhering to the matrix can be collected and used for other purposes, for instance as described above.

The means and methods described above can be varied in many ways within the scope of the claims.

I claim:

1. A method for atomizing a metal melt to form powder particles, comprising the steps of:

providing in a surrounding medium a first disintegration media jet having a considerable vertical extension and a generally horizontal flow direction, providing a second disintegration media jet having a considerable vertical extension and a generally horizontal flow direction, said first and second media jets intersecting in a vertical plane at an angle $\beta$ such that a vortex zone is established between the jets immediately before the intersection where a backward flow of disintegration media arises, and causing a vertical tapping stream of metal melt to pass down between said media jets in said zone, to form powder particles, wherein each said media jet is formed by a slot-shaped nozzle or a row of nozzles, the slot-shaped nozzles or rows of nozzles being separated from each other and located at generally the same horizontal plane.

2. A method as claimed in claim 1, including positioning the slot-shaped nozzles or rows of nozzles with longitudinal axes parallel to each other.

3. A method as claimed in claim 1, including positioning the slot-shaped nozzles or rows of nozzles with longitudinal axes at an acute angle to each other.

4. A method as claimed in, claims 1, 2 or 3, including establishing a contact region between disintegration media and melt as a length which is about 5–50 times greater than the diameter of the tapping stream.

5. A method as claimed in any one of claims 1, 2 or 3, wherein the angle $\beta$ between the media jets is between 0° and 60°.

6. A method as claimed in any one of claims 1, 2 or 3, including positioning the media jets to have a direction differing slightly from horizontal, wherein the angle $\beta$ between the media jets and the tapping stream varies between 45° and 135°, for controlling the quantity of atomized melt per length unit of the zone.

7. A method as claimed in any one of claims 1, 2 or 3, including producing a horizontal media jet or jets from separate nozzles located between and/or behind the slot-shaped nozzles or rows of nozzles, and directing said media jet or jets exactly opposite to the tapping stream to influence the degree of engagement of the tapping stream in the media jet.

8. A method as claimed in claim 1, further comprising, after forming said powder particles, cooling and recirculating said media jets.

9. A method as claimed in claim 5, wherein the angle $\beta$ is between 5° and 20°.

10. Apparatus for atomizing metal melts to form powder particles, comprising;

a container for the metal melt having outlet means therein providing a substantially vertical tapping stream of metal melt;

two slot-shaped nozzles or rows of nozzles, said slot-shaped nozzles or rows of nozzles being separated from each other, located at generally the same horizontal plane and having considerable vertical extension, said slot-shaped nozzles or rows of nozzles being oriented such that disintegration media jets passing therethrough intersect in a vertical plane at an angle $\beta$, and establish a vortex zone between the disintegration jets immediately before the intersection where a backward flow of disintegration media arises, said container being located with respect to the nozzles such that the vertical tapping stream falls into the vortex zone between the jets to be disintegrated to form powder particles.

11. Apparatus as claimed in claim 10, wherein the two slot-shaped nozzles or rows of nozzles have longitudinal axes parallel to each other or at an acute angle $\alpha$ to each other.

12. Apparatus as claimed in claim 10 or 11 including at least one further nozzle arranged directly horizontally against the tapping stream, between and/or behind the slot-shaped nozzles or rows of nozzles.

13. Apparatus as claimed in claim 10, further comprising means for cooling and recirculating media jets passing through said slot-shaped nozzles or rows of nozzles.

14. Apparatus as claimed in claim 10 or 11, further comprising a forming surface located with respect to said nozzles such that the media jets and particles impinge thereon.

* * * * *